US007520235B2

(12) United States Patent
Jiménez Del Amo

(10) Patent No.: US 7,520,235 B2
(45) Date of Patent: Apr. 21, 2009

(54) DEVICE FOR THE EXTRACTION OF A SUBMERGED ROPE USED TO MOOR A BOAT

(76) Inventor: Pedro Jiménez Del Amo, Ctra. la Roda, Munera. (ES) 02612

( * ) Notice: Subject to any disclaimer, the term of this patent is extended or adjusted under 35 U.S.C. 154(b) by 0 days.

(21) Appl. No.: 11/791,453

(22) PCT Filed: Oct. 20, 2005

(86) PCT No.: PCT/ES2005/000560

§ 371 (c)(1),
(2), (4) Date: Oct. 23, 2007

(87) PCT Pub. No.: WO2006/058932

PCT Pub. Date: Jun. 8, 2006

(65) Prior Publication Data

US 2008/0141920 A1 Jun. 19, 2008

(30) Foreign Application Priority Data

| | | |
|---|---|---|
| Nov. 29, 2004 | (ES) | 200402911 |
| Jun. 9, 2005 | (ES) | 200501384 |
| Jul. 26, 2005 | (ES) | 200501817 |

(51) Int. Cl.
*B63B 21/00* (2006.01)
*B63B 22/02* (2006.01)

(52) U.S. Cl. ..... 114/230.2; 441/3

(58) Field of Classification Search ..... 114/230.2
See application file for complete search history.

(56) References Cited

U.S. PATENT DOCUMENTS

| | | | | |
|---|---|---|---|---|
| 3,077,614 | A | 2/1963 | Lloyd | |
| 3,722,223 | A * | 3/1973 | Gratz | 405/219 |
| 3,899,990 | A | 8/1975 | Lecomte | |
| 3,950,806 | A | 4/1976 | Puchois | |
| 4,266,499 | A | 5/1981 | Tam | |
| 5,431,589 | A * | 7/1995 | Corona | 441/4 |

FOREIGN PATENT DOCUMENTS

| | | |
|---|---|---|
| DE | 34 32 868 | 3/1986 |
| DE | 101 57 313 | 6/2003 |
| EP | 0 502 219 | 9/1992 |
| ES | 1 046 405 | 12/2000 |
| FR | 2 236 719 | 2/1975 |

* cited by examiner

*Primary Examiner*—Jesus D Sotelo
(74) *Attorney, Agent, or Firm*—Wenderoth, Lind & Ponack, L.L.P.

(57) ABSTRACT

A device for the extraction of a submerged rope used to moor a boat, includes a rigid bar having joined thereto: a rope, the lower end of which is solidly connected to a mooring post; a water hose which is connected to a water supply at the port and which is used to supply water next to the tip of the rope; an inflatable element; and an element for limiting the course of the rigid bar upon inflation of the inflatable element, in order to maintain the assembly on the water bottom when the inflatable element is deflated and in order to remove the rope and the hose from the water to an adjustable height in relation to the level of the water when the inflatable element is inflated. The rigid bar can be a telescopic bar and, as such, the length thereof can be adjusted. In addition, the rigid bar can be raised with a hydraulic arm.

31 Claims, 8 Drawing Sheets

DEVICE FOR THE EXTRACTION OF A SUBMERGED ROPE USED TO MOOR A BOAT

BACKGROUND OF THE INVENTION

1. Object of the Invention

The present invention relates to a device intended for performing the extraction of a submerged rope used to moor a boat; and which has the aim of permitting adjustment of the height at which the rope is located above the level of water when its extraction is performed.

The invention is applied in the nautical sector in all manner of boats or other objects capable of floating and which have to be moored.

It is a further object of the invention to provide a water hose alongside the tip of the rope, in such a way that, at the same time as providing a means for mooring the boat, a water supply point is also provided at a height that can be adjusted above the level of water.

2. State of the Art

Nowadays, most boats moor in a port via their two ends, one of the ends being moored to the dock or wharf with one or more ropes and the other being moored with one or more ropes that are tied to a mooring post in the sea bottom of the port (concrete block or other securing element). In this regard, devices are known which comprise an inflatable element connected to the rope, which is fixed to the sea bottom via a mooring post.

In addition, the inflatable element is connected to a compressor by means of a flexible line in order to inflate it or deflate it at will, in such a way that when it is deflated it is resting on the sea bottom together with the rope, while when it is inflated the rope floats to the surface with its end in the air, such that it can be grasped from a boat in order to be tied.

In this regard, a German patent with publication number DE-3432868 and a European patent with publication number EP-0502219 can be cited, which describe a device of the stated characteristics, in which the rope consists of a chain that is attached to the buoy from which the rope emerges, and which present the drawback of not permitting any adjustment to the height at which the rope is located above the surface of the water, since the adjustment of that height makes it easier to perform the operation of grasping the rope in order to moor the boat.

Mention can also be made in this respect of European patent with publication number EP-1314641, which describes a device similar to the above, but with the particular feature that the chain for retaining the buoy is different from the mooring rope and in this case it is the mooring rope that is fixed to the buoy. This document also does not describe that the height at which the rope is located above the surface of the water can be adjusted.

American patent with publication number U.S. Pat. No. 3,899,990 can also be mentioned, which provides for a rigid structure that is tied directly to the mooring post and to the buoy to which is incorporated a mooring element for the boat, which means that this case too also presents the drawbacks already mentioned for the previous documents.

Finally, the existence can be mentioned of patent documents with application numbers U.S. Pat. No. 3,950,806 and U.S. Pat. No. 3,077,614, in which the buoy is attached to a rigid bar which projects above the level of the water in order to make it easier to grasp the rope, but in this case the buoy cannot be inflated or deflated and, moreover, it is not possible to carry out an adjustment in the height at which the rope has to be located with regard to the level of the water.

Another problem presented by this type of device consists of the fact that, as the rope is submerged in the water, the mud or sludge deposited on the sea bottom makes the rope dirty, so that, when the user performs the mooring, he gets his hands and the boat dirty and therefore then has to wash the dirt off. To do this, the user goes to a hose located on the dock or wharf, which on some occasions is close to the boat and on other occasions is far away, and he has to carry the hose as far as the boat in order to reach the mooring zone where the dirt is. This means that the user in addition dirties everything he touches and, after having performed the cleaning, he has to gather up the hose which, apart from the inconvenience that this entails, also represents a risk of accident since, when carrying out the cleaning, the floor becomes wet and there is a risk of slipping when it comes to gathering up the hose. None of the cited documents manages to overcome this problem.

SUMMARY OF THE INVENTION

In order to solve the drawbacks mentioned above, the invention has developed a novel device which, as with those described in the state of the art, comprises an inflatable element which is connected to the rope, one of whose ends is fixed to the sea bottom by means of a mooring post, all this in such a way that the inflatable element is connected to a compressor by means of a flexible line in order to carry out its inflating/deflating at will and permitting the rope to be located on the sea bottom together with the inflatable element when the latter is deflated, or permitting the rope to float when the inflating is carried out.

So, the invention is characterised by the fact that it presents a very particular and novel arrangement with regard to that described in the previous documents, in which provision is made for the incorporation of a rigid bar, at least the upper part of which is joined to the rope, to which the inflatable element is also joined at a certain distance from the upper end of the rigid bar, and to which is also joined an element for limiting the course of the rigid bar when the inflatable element is inflated; in such a way that the flotation of the inflatable element causes the upper part of the rigid bar to appear above the water to a degree that can be adjusted by means of the incorporation of the element for limiting the course of the rigid bar. This permits a choice to be made for the height above the level of water at which the tip of the rope is located, thus making it easier to moor the boat.

Moreover, the inventive device provides for the incorporation of a water hose which is connected to a water supply coming from the port or wharf and which is furthermore attached to at least an upper part of the rigid bar in order to supply water alongside the tip of the rope at a height that can be adjusted above the level of the water when the inflatable element is inflated.

This new characteristic has the great advantage that when the user performs the mooring, he is provided with a hose together with the rope, which allows him to clean the dirt deposited on the rope and on his hands and the hull of the boat when mooring. This dirt can thus be cleaned off quickly and simply by means of the water hose without any need for the user to have to go to the point of the port or wharf where the water hose is to be found, thereby also avoiding having to perform the later operation of gathering up the hose.

The element for limiting the course of the rigid bar consists of at least one rope which is fixed to the sea bottom by means of a mooring post and to the bar, which means that, when the inflatable element is inflated, the float may or may not be permitted to reach the surface due to the fact that it is located at a depth that is adjusted by the element for limiting the course of the rigid bar, in such a way that the length of the section of the rigid bar appearing above the surface is adjusted.

In the preferred embodiment of the invention, provision is made for the element for limiting the course of the rigid bar to consist of two ropes, each one of which is fixed to a mooring post. Both in this case and in the previous one, the rope or ropes are provided with a mechanism for adjusting their length in order to permit the height at which the rope is located above the level of the water to be varied, depending on the needs of the user. The preferred embodiment of the invention provides for the element for limiting the course of the rigid bar to consist of an elastic material or a semi-rigid material.

In order to effect the inflation and deflation, the compressor is connected to a timer which receives the signal from a telecontrol in order to perform the activation of the compressor during a sufficient period for allowing the user to moor the boat, maintaining the inflatable element inflated and, once that period has expired, the inflatable element is deflated by disconnecting the compressor. The telecontrol is intended to communicate with a remote control or be activated directly by means of a push-button.

In order to carry out the filling and emptying of air to and from the inflatable element, provision is made for the incorporation of an electrovalve which functions simultaneously with the compressor, and which also includes a pressure gauge and a pressure regulator for keeping the pressure at the proper levels in the entire air circuit.

The compressor is provided in the port or wharf, or on the boat itself, in such a way that in the latter case the compressor is connected to a flexible line of the port by means of a flexible pipe and via a connector which includes a calibrated opening of dimensions that permit the inflatable element to be inflated and then to be deflated after a period established by the timer has passed. Once that time has elapsed, the deflation of the inflatable element takes place by means of the calibrated opening. The incorporation of the calibrated opening permits the use of the electrovalve, pressure gauge and pressure valve to be omitted, thus obtaining a simpler structure. This opening can be incorporated into any point of the circuit that is not submerged.

The rope and the water hose are joined along the rigid bar, for example, being fixed to the outside of it or running along the inside.

In one embodiment of the invention, provision is made for the water hose to be connected to a pressure pump, located on the dock or wharf, in order to pump the water if necessary. Another embodiment of the invention provides for the arrangement of an electrovalve, likewise located on the dock or wharf, in order to effect the opening and closing for the passage of water.

Both the pressure pump and the electrovalve are connected to a telecontrol for governing their operation remotely, such as for example from the boat by means of a remote control or by a push-button connected to the telecontrol.

The end of the hose is suitable for incorporating a shutoff valve for opening or closing to adjust the flow of water.

An embodiment of the invention provides that the connection of the upper part of the rigid bar to the rope is done solely at its upper end and the rigid bar is connected to a counterweight, so that, when the inflatable element is inflated and the rope is located above the level of the water, the rigid bar remains vertical when the inflatable element is inflated. The connection of the upper part of the rigid bar is done in a way that is fixed or sliding, for example, by means of a ring.

The invention provides that the inflatable element consists of two inflatable buoys joined to the rigid bar in order to grant greater stability to it when it projects above the surface of the water.

In this case, when the inflatable element is inflated, the element for limiting the course of the rigid bar is joined to at least the lower end of the rigid bar, and more specifically it is connected longitudinally to a lower part of the rigid bar. This connection is done by means of flanges in order to facilitate the vertical arrangement of the rigid bar when it appears above the surface of the water.

When the boat is cast off, the inflatable element is deflated and the rigid bar submerges together with the rope, which, and above all in cases in which the rigid bar is inclined, can cause the bar to collide against the hull of the boat on account of its proximity. Provision is therefore made for the rigid bar, at a point below its connection with the element for limiting the course of the rigid bar, to include at least one unidirectional hinge with a stop that limits the movement of the rigid bar from a bent position to a straight position with its sections aligned, in such a way that when the boat is cast off, the rigid bar bends due to the hinge, thus avoiding the hull of the boat when submerging.

In order to facilitate the bending/straightening, provision is made for the lower end of the rigid bar to be fitted with a counterweight. In one embodiment of the invention, two hinges are provided in order to facilitate this operation.

The invention provides for the possibility of the rigid bar being adjustable in length, for which it has a telescopic design which includes a stop that prevents the section of smaller diameter from being able to exit from that of larger diameter when the telescopic bar is extended. in this case, the lower end of the lower section of the telescopic bar is fixed by means of a unidirectional hinge to a platform secured to the sea bottom and the upper section of the telescopic bar is fixed to the inflatable element so that, when the latter is inflated, it causes the telescopic bar to become extended. The element for limiting the course of the rigid bar is fixed to the upper section of the telescopic bar in order to permit adjustment of the height at which the upper end of the telescopic bar is located above the level of the water.

In this latter design, a variant is also provided in which the lower section of the telescopic bar is joined to the inflatable element, and its upper section to a second inflatable element, in order to carry out the function of extending the telescopic bar in a way that is quicker and more efficient. In this case, the upper section of the telescopic bar is also attached to the element for limiting the course of the rigid bar in order to adjust the height at which it is located above the water.

Finally, the invention provides that the platform described above includes a hydraulic arm that is joined to the rigid bar, for which provision is made for a hydraulic line for air or oil which runs along the sea bottom and is connected to a set of hydraulic equipment, operated by a remote control, and located in the port or on the boat itself, in such a way that in the latter case the hydraulic equipment is connected to the air or oil line of the port by means of a flexible pipe.

This embodiment is preferably intended for use with a rigid bar of the type that consists of a telescopic bar, in which case its upper section is joined to the inflatable element and to the element for limiting the course of the rigid bar, in order to achieve the functionalities described above.

Below, in order to aid a better understanding of this specification and forming an integral part thereof, a series of figures is attached in which, on an illustrative rather than limiting basis, the object of the invention has been represented.

DETAILED DESCRIPTION OF THE INVENTION

Given below is a description of the invention based on the figures mentioned above.

Figure 1:
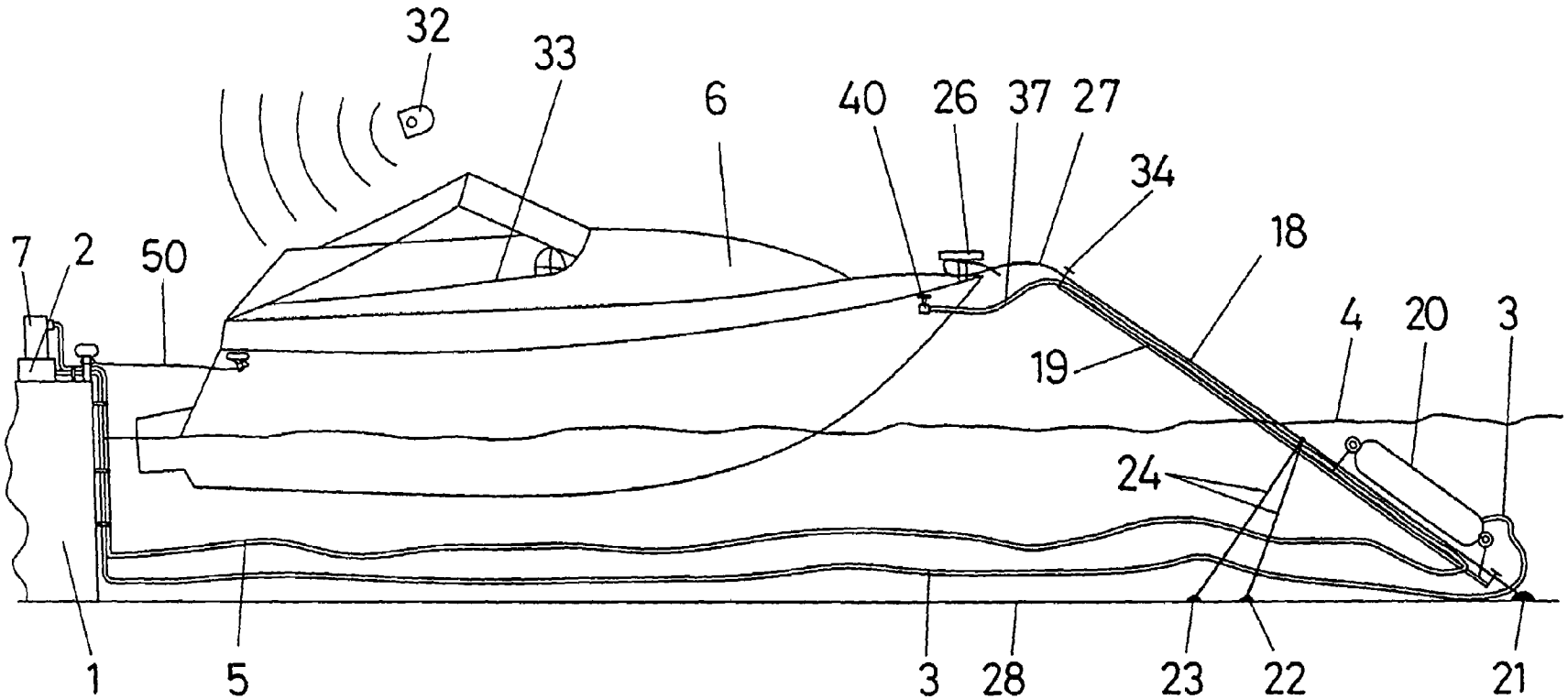
FIG. 1.—Shows a schematic view of the basic embodiment of the invention.
Figure 2:
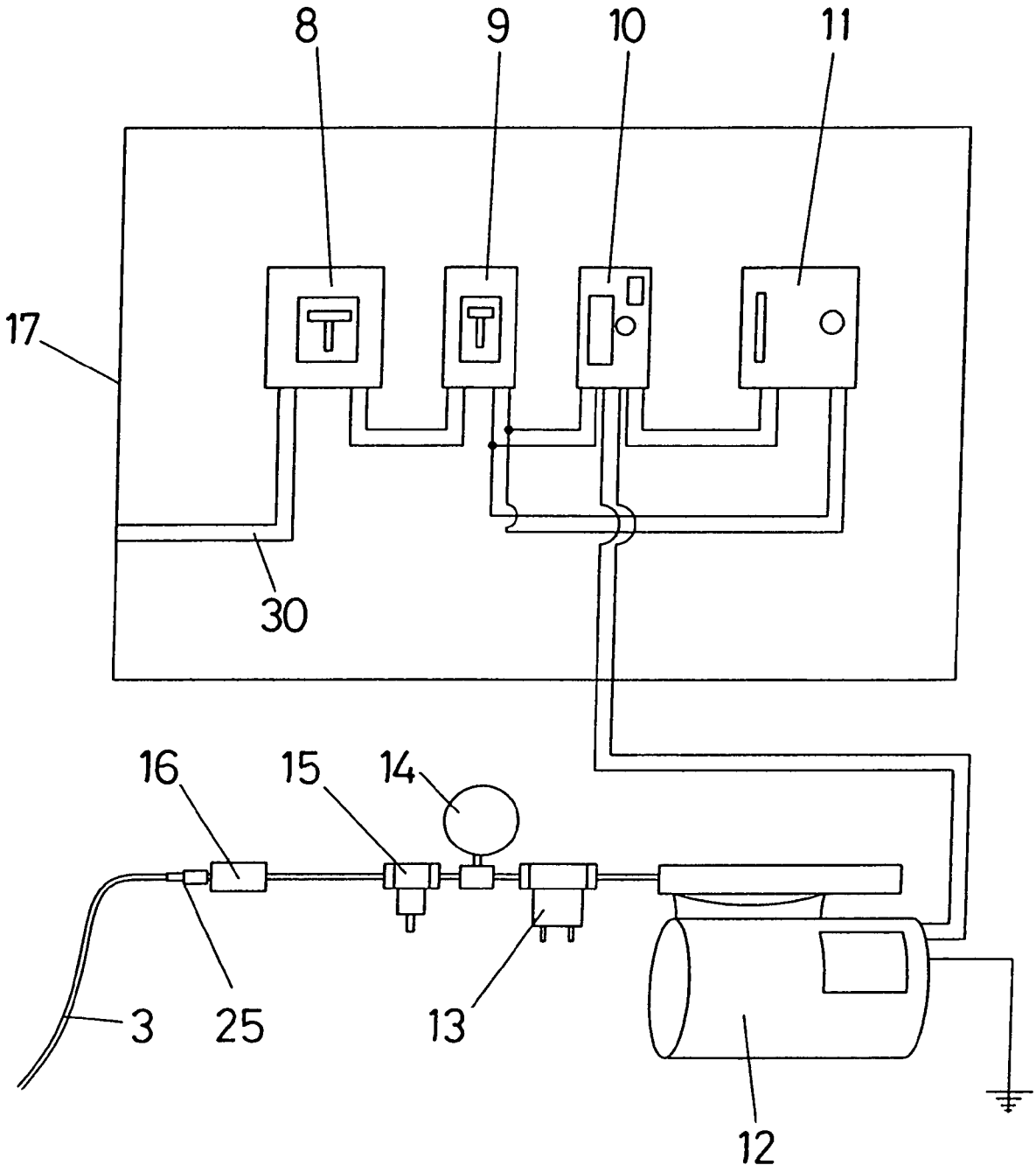
FIG. 2.—Shows a diagram of the electrical and pneumatic circuit permitting the inflatable element to be inflated.

FIG. 1 shows a general view of a boat 6 moored in a port 1 via its stern by means of a rope 50, with the bow being furthermore moored to a rope 18, which forms part of the inventive device, and whose lower end is joined to a mooring post 21 secured to the sea bottom 28.

The rope 18 is joined along a rigid bar 19 in such a way that the tip 27 of the rope 18 projects with respect to the rigid bar 19 in order to permit the mooring of the boat 6 to be performed.

Moreover, the rigid bar 19 is joined to an inflatable element 20 which is connected by means of a flexible line 3 to a compressor 12 for carrying out the inflating and deflating of the inflatable element 20 at will, as will be explained further below.

The rigid bar 19 is solidly connected to two ropes 24, the ends of which are connected to separate mooring posts 22 and 23 which are fixed to the sea bottom 28.

The connection of the flexible line 3 to the compressor 12 is done by means of a connector 25 which is linked to the corresponding quick-release air socket 16, a safety valve 15, a pressure gauge 14 and an electrovalve 13, all housed in a cabinet 2 located at any point of the port 1. Also included in the cabinet is a sealed box 17 housing a differential 8, a magnetothermal device 9, a timer 10 and a telecontrol 11.

When the inventive device is not in use, it lies on the sea bottom 28, for which the inflatable element 20 is without air, a position in which the rope 18, bar 19 and the inflatable element 20 are all located on the sea bottom 28.

When the user wishes to moor the boat 6, he activates a remote control 32 or push-button 33, the latter being connected to the telecontrol 11, so that the latter receives a signal coming from the push-button 33 or from the remote control 32.

The telecontrol then activates the timer 10 which feeds the compressor 12 via the differential 8 and magnetothermal device 9, which are intended to cut off the current if any breakdown or overloading occurs in the electrical circuit. By means of the timer 10, the compressor is kept working for a sufficient period for inflating the inflatable element 20, the electrovalve 13 being activated in order to permit the passage of air to the flexible line 3.

When air is injected into the inflatable element 20, this element starts to rise to the surface and as it does so it pulls the rigid bar 19 along with it, this bar being in turn attached to the rope 18 in such a way that the end 34 of the rigid bar 19 appears at the surface together with the tip 27 of the rope 18.

The course of the rigid bar 19 is limited by the arrangement of the ropes 24, such that they adjust the height at which the tip 27 of the rope 18 is located with respect to the level of water.

In this way, the tip 27 remains located at the height required by the user in a comfortable position for grabbing it and being able to moor the boat 6 at the end 26 of its bow.

Moreover, the ropes 24 are adjustable in length in order to be able to modify the height at which the tip 27 of the rope 18 has to be located, in such a way that the ropes 24 determine an element for limiting the course of the rigid bar 19 when the inflatable element 20 is inflated.

The time set by the timer is sufficient for allowing the user to moor the boat so that, once that time has elapsed, the compressor 12 and electrovalve 13 are deactivated, which causes the inflatable element to deflate automatically so that the device is then ready to submerge when the user casts off the boat 6.

An alternative provided for by the invention consists of the incorporation in the connector 25, or at any other point of the circuit that is not submerged, of a calibrated opening so that the electrovalve 13, pressure gauge 14 and pressure valve 15 can be done without. The dimensions of the calibrated opening are suitable for permitting the inflation of the inflatable element 20, in spite of the leak of air that takes place, all this in a manner such that, once the time set by the timer 10 has passed, the functioning of the compressor 12 halts and the inflatable element 20 deflates via the calibrated opening.

The flexible line 3 is fixed by means of clips in order to keep it in a suitable position.

The sealed box 17 includes quick-release sockets so that it can be removed together with all the components it houses thus making it easier to change its location and its fitting.

Moreover, the invention provides for the incorporation of a water hose 5 which is fixed along the rigid bar 19 and runs along the sea bottom 28 as necessary to be connected with a water supply 7 provided in the dock 1 or wharf. More specifically, the hose 5 runs along the inside or the outside of the rigid bar 19.

By means of this arrangement, when the inflatable element 20 is inflated, in the way just mentioned, the water hose 5 is made available along with the tip 27 of the rope 18 so that, when the user performs the mooring of the boat, in the way already described, the dirt that has been deposited on the tip 27 and which will have impregnated the user's hands and the boat itself can be washed off using the water supplied from the hose 5.

In order to carry out the supply of water, the invention provides for the end of the hose 5 to include a shutoff valve 40, the operation of which closes or opens the flow of water.

The water supply 7 can include a pressure pump (not represented in the figures) in order to pump the water when necessary, and it can also include an electrovalve, also not represented in the figures, for opening or closing the flow of water.

In either of the two cases, both the pressure pump and the electrovalve are connected to a telecontrol in order to permit remote opening from the boat by means of a remote control 32 in a manner equivalent to how the inflating of the inflatable element 20 was governed.

Figure 3:
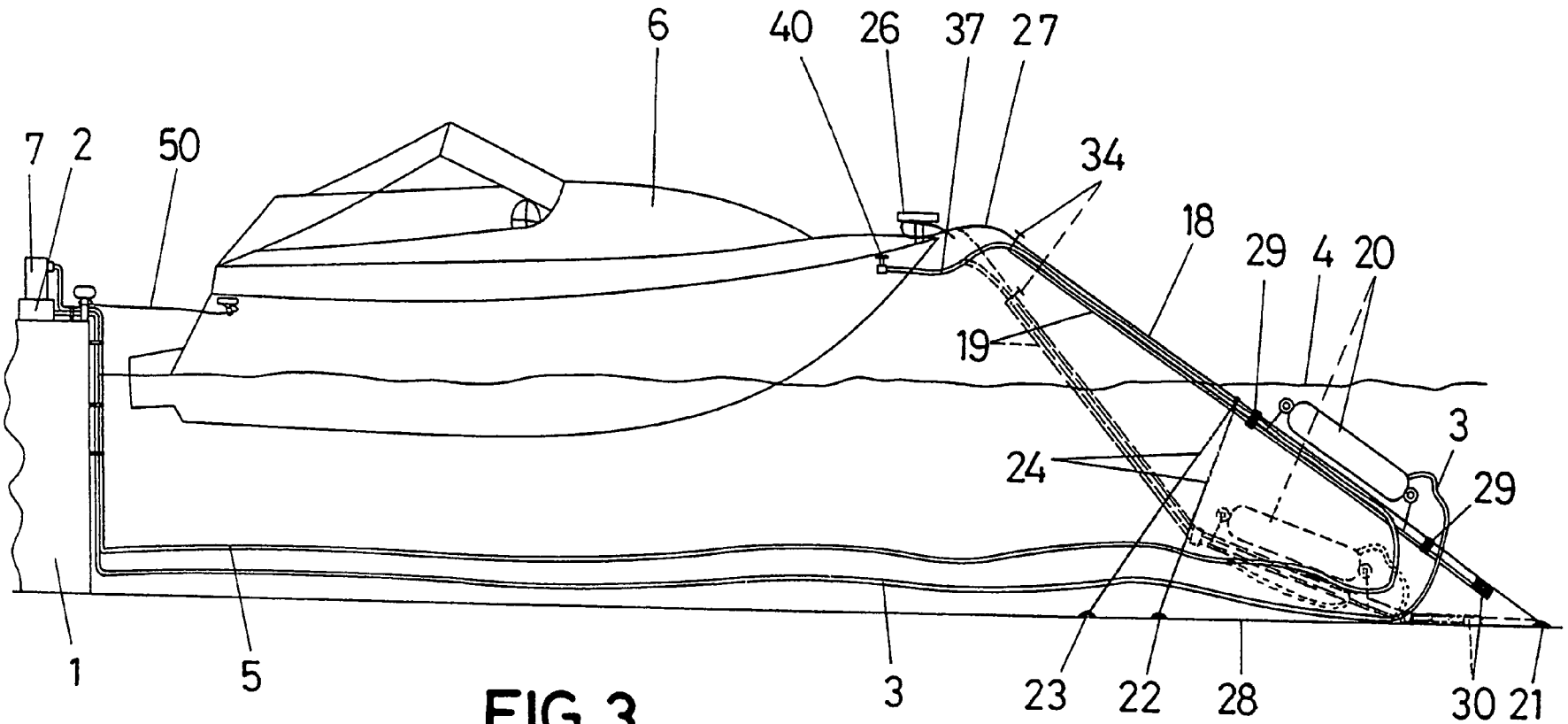
FIG. 3.—Shows an example of an embodiment equivalent to that of FIG. 1 but in which a rigid bar includes hinged points so that the bar can be bent when the boat is cast off, thus preventing it from being able to collide with the hull of the boat.

FIG. 3 shows another possible embodiment of the invention in which the rigid bar 19 is provided with two unidirectional hinges 29 in order to facilitate the operation of submerging the rigid bar 19 as described below.

As shown in FIG. 3, the hinges 29 are arranged below the point where the ropes 24 are fixed, so that when the user wishes to cast off the boat, given that the inflatable element 20 is deflated, as already described, the rigid bar tends to submerge when the boat is cast off and it finds its route blocked by the hull of the boat 6, as a result of which it bends in a single direction due to the hinges 29, as shown by means of the dashed line, in such a way that the operation of submerging the rigid bar 19 is facilitated. In order to facilitate this operation further, a counterweight 30 is included at the lower end of the rigid bar 19. In the example of embodiment, two hinges 29 have been incorporated, though of course the number of hinges can vary according to the needs of the device, with just a single hinge 29 being able to be incorporated.

The hinges 29 are arranged below the connection point of the ropes 24, and they present an arrangement such that they include a stop which maintains the alignment of the different sections of the rigid bar 19 produced by the hinges 29 when the bar is straightened out on rising to the surface.

Figure 4:
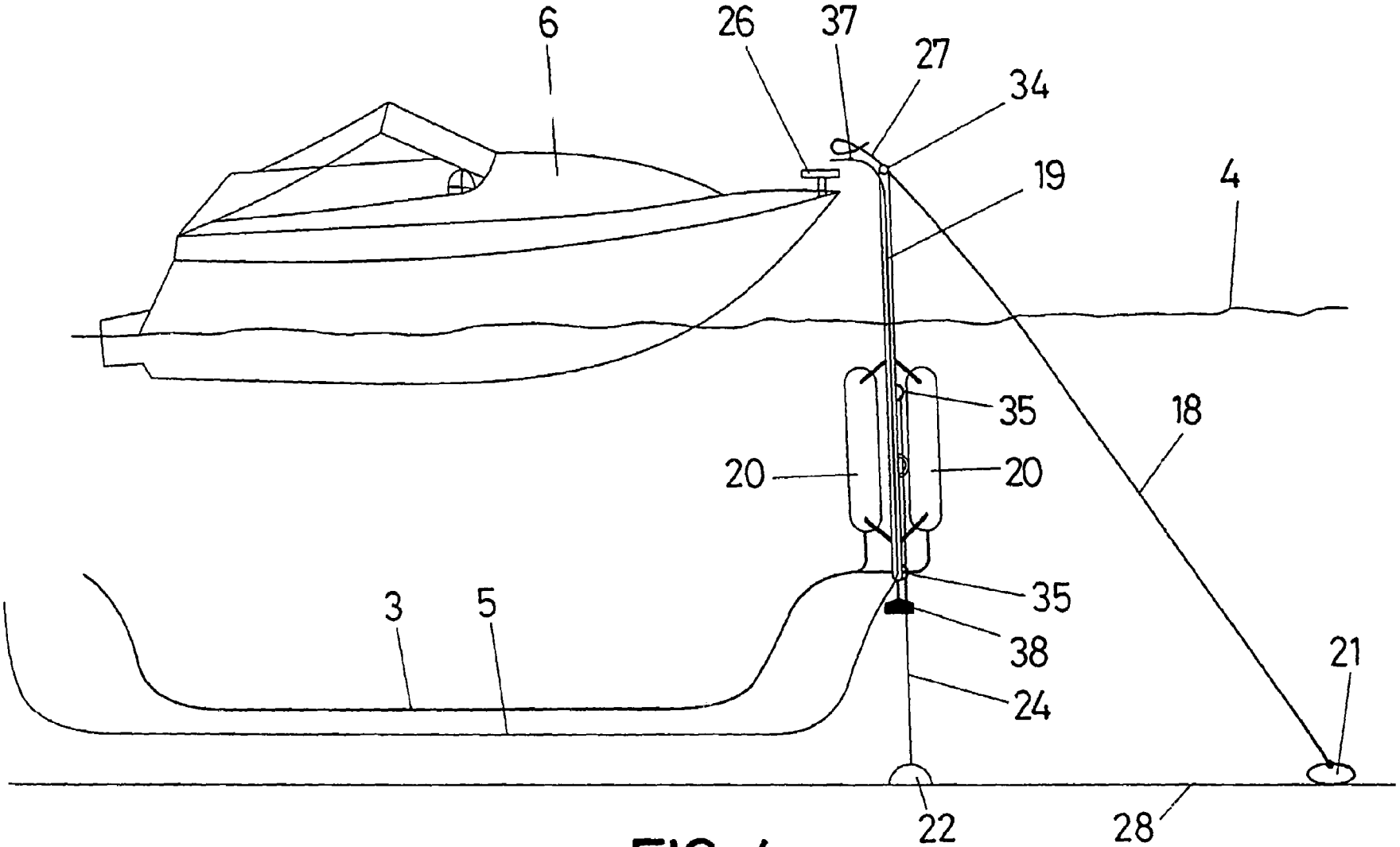
FIG. 4.—Shows a schematic view of another possible embodiment of the invention in which the bar is located vertically when it emerges above the surface of the water.

FIG. 4 shows another example of an embodiment in which the inflatable element 20 consists of two inflatable buoys which grant greater stability to the rigid bar 19 when it appears above the surface 4.

In this embodiment, the rigid bar 19 is joined at its lower end to a counterweight 38 which keeps the rigid bar 19 in a vertical position when it appears above the water.

Moreover, in this example provision is made such that the element for limiting the course of the rigid bar 19 when the inflatable element 20 is inflated consists of a single rope 24 joined to a mooring post 22 located on the sea bottom 28. The rope 24 is joined along the lower section of the rigid bar 19 by means of some flanges 35, in such a way that the rigid bar 19 is kept vertical while the inflatable element 20 is being inflated.

Figure 5:
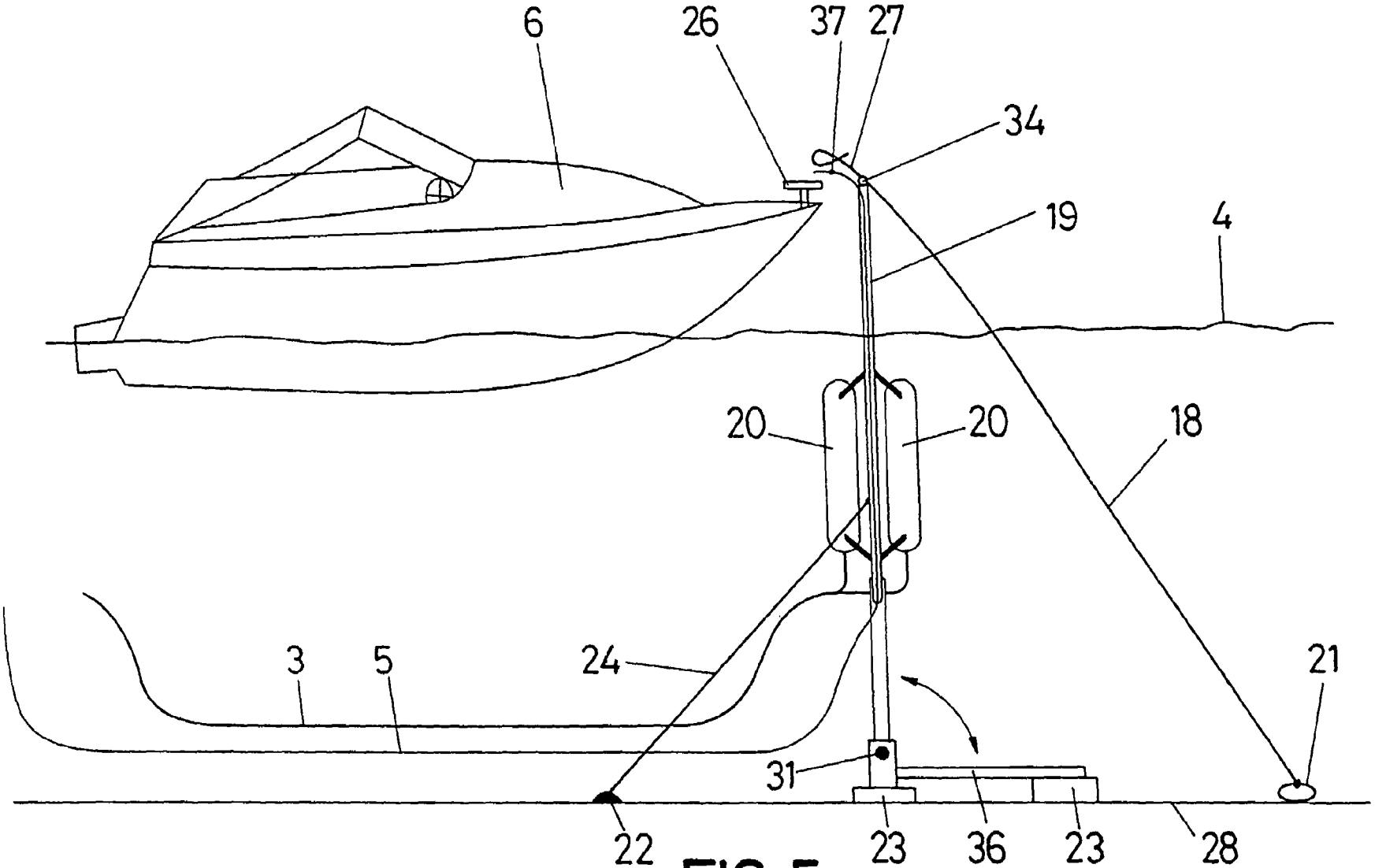
FIG. 5.—Shows another example of an embodiment in which the rigid bar is a telescopic bar with adjustable length and which, as with the previous case, is located vertically when it emerges above the surface of the water.

FIG. 5 shows another example of an embodiment of the invention in which the rigid bar 19 consists of a telescopic bar the length of which can be adjusted. In this case, the lower end is joined to a mooring post 23 by means of a unidirectional hinge 31 which includes a stop for maintaining the telescopic bar 19 in its vertical position when the inflatable element 20 is inflated. For that reason, the rigid bar 19 is going to act as a lever on the mooring post 23 for which the latter is attached to a platform 36, which is in turn secured via another mooring post 23 to the sea bottom in order to mitigate the levering effect.

In this embodiment, the inflatable element 20 is fixed to the upper part of the first telescopic bar, in such a way that when the inflatable element 20 is inflated, the telescopic bar becomes extended to a length limited by the rope 24, with the height of the tip 27 of the rope 18 above the level 4 of the water being adjusted in a manner equivalent to how this was done in earlier embodiments. For this purpose, the rope 24 is joined to the upper part of the telescopic bar 19.

Moreover, in this embodiment provision is made for the sections of the telescopic bar 19 to include a stop which prevents the section of smaller diameter from being able to accidentally exit from the inside of the section of larger diameter when the bar is being extended, or in the event of the rope 24 becoming broken.

Figure 6:
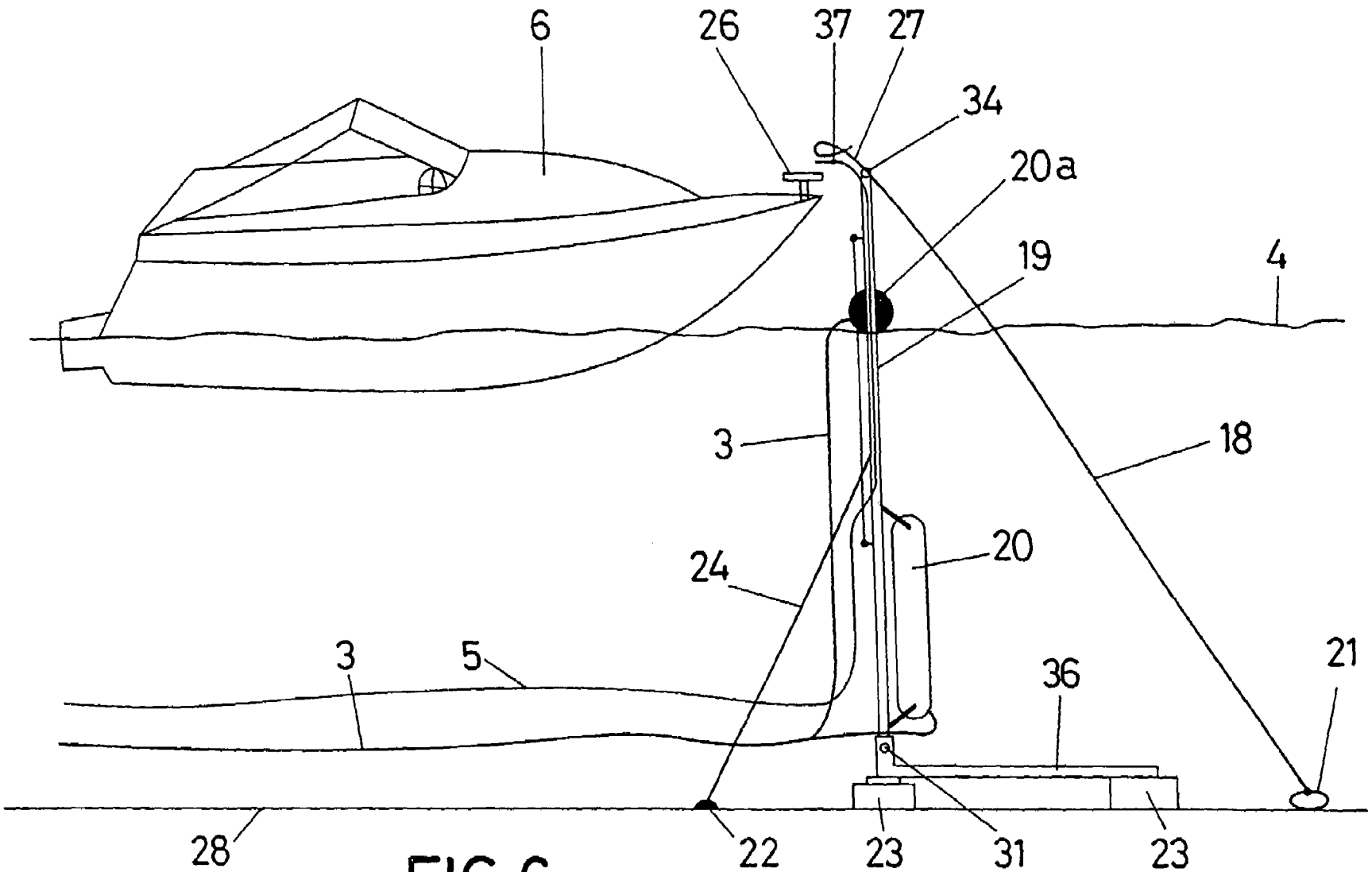
FIG. 6—Shows a view of a variant of the embodiment of the previous figure.

FIG. 6 shows a variant of the embodiment shown in FIG. 5, consisting of the incorporation of a second inflatable element 20*a*, joined to the upper section of the telescopic bar 19, the inflatable element 20 being incorporated into the lower section of the telescopic bar 19, with the same operation being achieved as described by means of FIG. 5.

Figure 7:
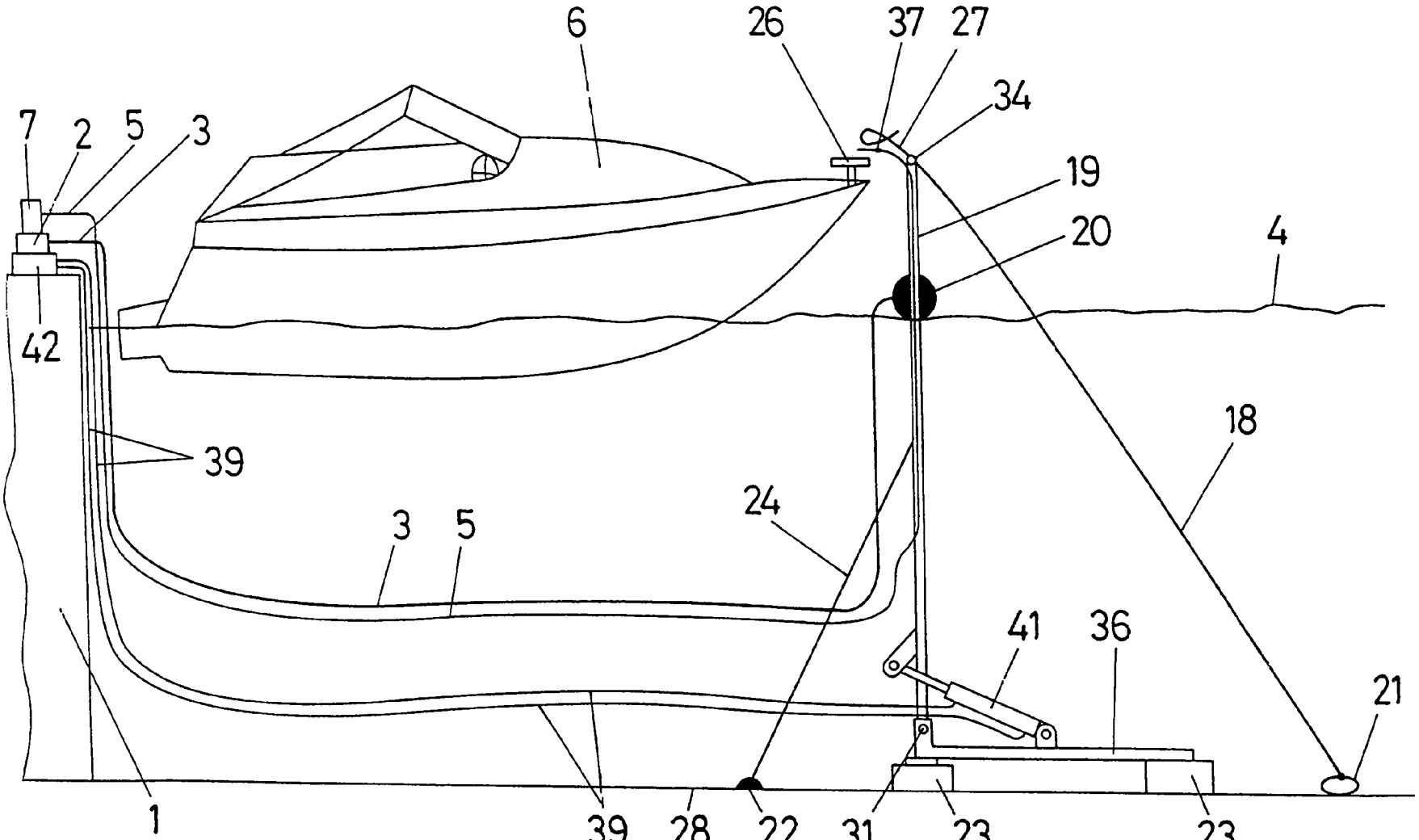
FIG. 7—Shows another possible variant of the embodiment of FIG. 5.

FIG. 7 shows another variant of the embodiment of FIGS. 5 and 6, with the particular feature that in this case provision has been made for the incorporation of a hydraulic arm 41 which is joined to the platform 36 and to the lower section of the telescopic bar 19 in order to produce the elevation of the telescopic bar 19, the upper end of which also includes the inflatable element 20 which carries out the extraction of the telescopic bar when that element is inflated.

In order to operate the hydraulic arm 41, provision is made for the incorporation of a hydraulic circuit 42 which is connected to the hydraulic arm 41 by means of some lines 39 via which flows the oil to and from the hydraulic circuit 42.

Figure 8:
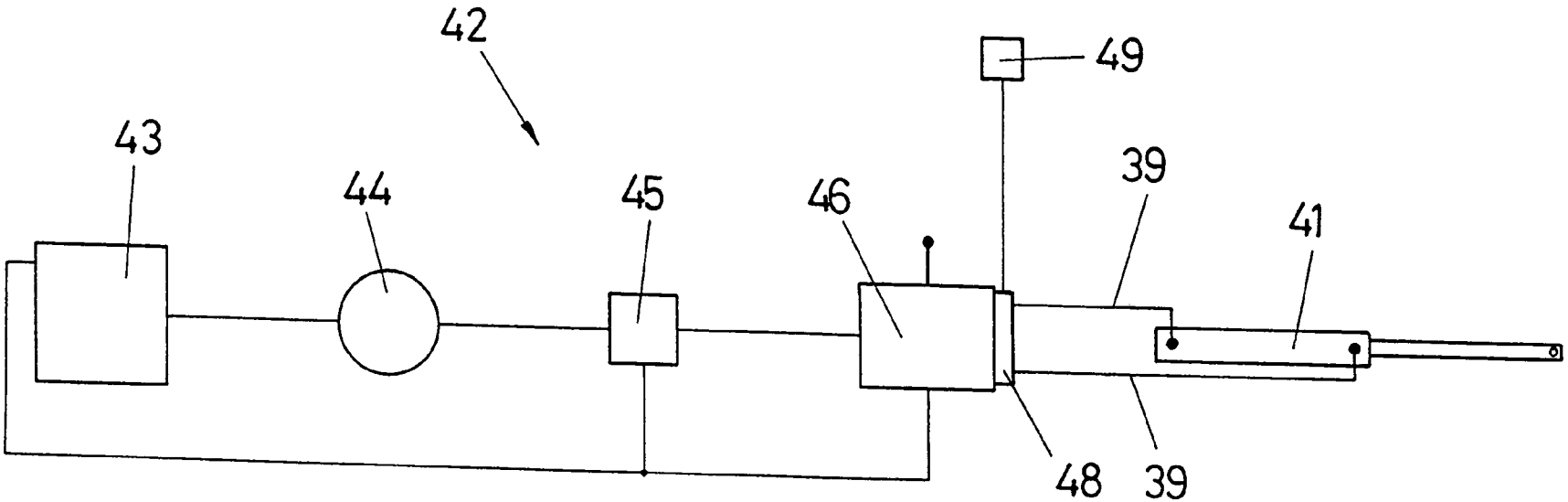
FIG. 8—Shows a diagram of the circuit permitting the functioning of the hydraulic arm represented in the previous figure to be controlled.

FIG. 8 shows the arrangement of the hydraulic circuit 42, which consists of an oil reservoir 42, a motor pump 44, a safety valve 45 and a distributor 46 via which the oil is distributed to one of the sides of the hydraulic arm 41 in order to raise or lower the rigid bar 19, a function which can also be performed by means of a manually operated lever 47 or by means of an electrovalve 48 operated by a signal receiver 49 which incorporates a telecontrol that can be operated by means of a remote control 32.

The hydraulic device 42 can be fitted in the port 1 or on the boat 6, in such a way that in the latter case some connection pipes are incorporated (not represented in the figures) with quick-release sockets for connection to the oil lines 39 incorporated in the port 1. In this latter embodiment, the inflatable element 20 produces the extension of the telescopic bar 19, the second section of which is attached to the rope 24 in order to limit its course and govern the height at which the end 34 of the telescopic bar 19 is located.

In the examples of the embodiments of FIGS. 5 to 7, the possibility exists of the rope 24 having sufficient length for permitting the inflatable element or the second inflatable element 20*a* to float, in such a way that the end 34 of the telescopic bar 19 is always kept at the same height independently of the rising or falling of the tide, due to the fact that the inflatable element 20 or 20*a* is kept floating and the telescopic bar 19 is extended or shortened in accordance with the tides.

The invention claimed is:

1. DEVICE FOR THE EXTRACTION OF A SUBMERGED ROPE USED TO MOOR A BOAT, said device comprising: an inflatable element connected to a rope, one of whose ends is fixed to the sea bottom by means of a mooring post, the inflatable element being furthermore connected to a compressor by means of a flexible air line for inflating the inflatable element and pulling the rope up to the surface to permit the boat to be moored, and for deflating the inflatable element and submerging it along with the rope when the boat is cast off; a rigid bar at least the upper part of which is joined to the rope and to which is also joined the inflatable element at a certain distance from the upper end; and an element for limiting the course of the rigid bar when the inflatable element is inflated, in order to adjust the height above the level of water at which a tip of the rope is located.

2. DEVICE FOR THE EXTRACTION OF A SUBMERGED ROPE USED TO MOOR A BOAT, according to claim 1, further comprising a water hose which is connected to a water supply provided in the port, which is fixed to at least an upper section of the rigid bar in order to provide water alongside the tip of the rope at an adjustable height above the level of the water.

3. DEVICE FOR THE EXTRACTION OF A SUBMERGED ROPE USED TO MOOR A BOAT, according to claim 2, further comprising a pressure pump for pumping the water, and a telecontrol operably connected to the pressure pump for governing remote operation of the pressure pump.

4. DEVICE FOR THE EXTRACTION OF A SUBMERGED ROPE USED TO MOOR A BOAT, according to claim 3, wherein an end of the hose incorporates a shutoff valve for the water.

5. DEVICE FOR THE EXTRACTION OF A SUBMERGED ROPE USED TO MOOR A BOAT, according to claim 2, further comprising an electrovalve for performing opening and closing of the passage of water in the water hose, and a telecontrol operably connected to the electrovalve for performing remote opening thereof.

6. DEVICE FOR THE EXTRACTION OF A SUBMERGED ROPE USED TO MOOR A BOAT, according to claim 2, wherein an end of the hose incorporates a shutoff valve for the water.

7. DEVICE FOR THE EXTRACTION OF A SUBMERGED ROPE USED TO MOOR A BOAT, according to claim 2, wherein the rope and the water hose are joined along the rigid bar.

8. DEVICE FOR THE EXTRACTION OF A SUBMERGED ROPE USED TO MOOR A BOAT, according to claim 2, wherein the water hose and the flexible air line run along an inside of the rigid bar.

9. DEVICE FOR THE EXTRACTION OF A SUBMERGED ROPE USED TO MOOR A BOAT, according to claim 2, wherein the connection of the upper part of the rigid bar to the rope is effected solely at its upper end in a manner selected between fixed and sliding, and the rigid bar is joined to a counterweight in order to keep the rigid bar vertical when the inflatable element is inflated.

10. DEVICE FOR THE EXTRACTION OF A SUBMERGED ROPE USED TO MOOR A BOAT, according to claim 1, wherein the element for limiting the course of the rigid bar comprises at least one rope which is fixed to the rigid bar and to the sea bottom by means of a mooring post.

11. DEVICE FOR THE EXTRACTION OF A SUBMERGED ROPE USED TO MOOR A BOAT, according to claim 10, wherein the element for limiting the course of the rigid bar comprises means for adjusting its length and is selected from between a rigid material and a semi-rigid material.

12. DEVICE FOR THE EXTRACTION OF A SUBMERGED ROPE USED TO MOOR A BOAT, according to claim 10, wherein the rigid bar, below its connection with the element for limiting the course of the rigid bar, contains at least one unidirectional hinge with a stop which limits the movement of the rigid bar from a bent position to a straight position in which its two ends are aligned; and in that the lower end of the rigid bar is joined to a counterweight so that, when mooring or casting off the boat, the rigid bar has flexibility, thus preventing the rigid bar from colliding against the hull of the boat when submerging.

13. DEVICE FOR THE EXTRACTION OF A SUBMERGED ROPE USED TO MOOR A BOAT, according to claim 1, wherein the element for limiting the course of the rigid bar comprises two ropes fixed to the rigid bar and to the sea bottom by means of two different mooring posts.

14. DEVICE FOR THE EXTRACTION OF A SUBMERGED ROPE USED TO MOOR A BOAT, according to claim 13, wherein the element for limiting the course of the rigid bar includes means for adjusting its length and is selected from between a rigid material and a semi-rigid material.

15. DEVICE FOR THE EXTRACTION OF A SUBMERGED ROPE USED TO MOOR A BOAT, according to claim 13, wherein the rigid bar, below its connection with the element for limiting the course of the rigid bar, contains at least one unidirectional hinge with a stop which limits the movement of the rigid bar from a bent position to a straight position in which its two ends are aligned; and the lower end of the rigid bar is joined to a counterweight so that when mooring or casting off the boat, the rigid bar has flexibility, thus preventing the rigid bar from colliding against the hull of the boat when submerging.

16. DEVICE FOR THE EXTRACTION OF A SUBMERGED ROPE USED TO MOOR A BOAT, according to claim 1, wherein the compressor is connected to a timer which receives the signal from a telecontrol in order to activate the compressor; and further comprising an electrovalve governed by the timer for permitting the inflatable element to be emptied and filled with air, comprising a pressure gauge and a pressure regulator, in order to maintain adequate pressure in the inflatable element.

17. DEVICE FOR THE EXTRACTION OF A SUBMERGED ROPE USED TO MOOR A BOAT, according to claim 16, wherein the compressor is located in the port.

18. DEVICE FOR THE EXTRACTION OF A SUBMERGED ROPE USED TO MOOR A BOAT, according to claim 1, wherein the compressor is located in the port.

19. DEVICE FOR THE EXTRACTION OF A SUBMERGED ROPE USED TO MOOR A BOAT, according to claim 1, wherein the rope is joined along the rigid bar.

20. DEVICE FOR THE EXTRACTION OF A SUBMERGED ROPE USED TO MOOR A BOAT, according to claim 1, wherein the flexible air line runs along an inside of the rigid bar.

21. DEVICE FOR THE EXTRACTION OF A SUBMERGED ROPE USED TO MOOR A BOAT, according to claim 1, wherein the connection of the upper part of the rigid bar to the rope is effected solely at its upper end in a manner selected between fixed and sliding, and the rigid bar is joined to a counterweight in order to keep the rigid bar vertical when the inflatable element is inflated.

22. DEVICE FOR THE EXTRACTION OF A SUBMERGED ROPE USED TO MOOR A BOAT, according to claim 21, wherein the element for limiting the course of the rigid bar when the inflatable element is inflated is joined to at least the lower end of the rigid bar and specifically is joined longitudinally to a lower end of the rigid bar.

23. DEVICE FOR THE EXTRACTION OF A SUBMERGED ROPE USED TO MOOR A BOAT, according to claim 21, wherein the inflatable element comprises two inflatable buoys joined to the rigid bar.

24. DEVICE FOR THE EXTRACTION OF A SUBMERGED ROPE USED TO MOOR A BOAT, according to claim 1, wherein the inflatable element comprises two inflatable buoys joined to the rigid bar.

25. DEVICE FOR THE EXTRACTION OF A SUBMERGED ROPE USED TO MOOR A BOAT, according to claim 1, wherein the rigid bar is adjustable in length, for which it has a telescopic design which includes a stop that prevents the section of smaller diameter from being able to exit from that of larger diameter when carrying out the extension.

26. DEVICE FOR THE EXTRACTION OF A SUBMERGED ROPE USED TO MOOR A BOAT, according to claim 25, wherein the lower end of the lower section of the telescopic bar is fixed by means of a unidirectional hinge to a platform secured to the sea bottom; the upper section of the telescopic bar is fixed to the inflatable element in order to extend the telescopic bar when the inflatable element is inflated; and the unidirectional hinge includes a stop which maintains the telescopic bar in a vertical position.

27. DEVICE FOR THE EXTRACTION OF A SUBMERGED ROPE USED TO MOOR A BOAT, according to claim 26, wherein the upper section of the telescopic bar is fixed to the element for limiting the course of the telescopic bar.

28. DEVICE FOR THE EXTRACTION OF A SUBMERGED ROPE USED TO MOOR A BOAT, according to claim 25, wherein the lower end of the lower section of the telescopic bar is fixed by means of a unidirectional hinge to a platform secured to the sea bottoms; the lower section of the telescopic bar is fixed to the inflatable element, and its upper section is joined to a second inflatable element, in order to extend the telescopic bar when the inflatable element is inflated; and the unidirectional hinge includes a stop which maintains the telescopic bar in a vertical position.

29. DEVICE FOR THE EXTRACTION OF A SUBMERGED ROPE USED TO MOOR A BOAT, according to claim 28, wherein the upper section of the telescopic bar is fixed to the element for limiting the course of the telescopic bar.

30. DEVICE FOR THE EXTRACTION OF A SUBMERGED ROPE USED TO MOOR A BOAT, according to claim 25, wherein the lower end of the lower section of the telescopic bar is fixed by means of a unidirectional hinge to a platform secured to the sea bottom to which is also fixed a hydraulic arm for elevation of the telescopic bar, for which provision is made for an oil line which runs along the sea bottom and is connected to a hydraulic circuit operated by a remote control; and the unidirectional hinge includes a stop which maintains the telescopic bar in a vertical position.

31. DEVICE FOR THE EXTRACTION OF A SUBMERGED ROPE USED TO MOOR A BOAT, according to claim 30, wherein the upper section of the telescopic bar is fixed to the element for limiting the course of the telescopic bar.

* * * * *